United States Patent [19]

Miyahara

[11] 3,982,880

[45] Sept. 28, 1976

[54] LIQUID FUEL BURNER

[75] Inventor: Kingo Miyahara, Tokyo, Japan

[73] Assignee: Dowa Co., Ltd., Tokyo, Japan

[22] Filed: Apr. 9, 1975

[21] Appl. No.: 566,225

[30] Foreign Application Priority Data

| | | |
|---|---|---|
| Apr. 24, 1974 | Japan | 49-46343 |
| Apr. 24, 1974 | Japan | 49-46344 |
| Oct. 15, 1974 | Japan | 49-124303[U] |

[52] U.S. Cl. ..... 431/168; 431/190; 431/210

[51] Int. Cl.[2] ..... F23D 11/04

[58] Field of Search ..... 431/168, 210, 190, 8; 239/214.17, 214.25

[56] References Cited

UNITED STATES PATENTS

| | | | |
|---|---|---|---|
| 73,506 | 1/1868 | Cook | 431/168 |
| 1,699,067 | 1/1929 | Holmgren | 431/168 |
| 3,844,705 | 10/1974 | Miyahara | 431/168 |

*Primary Examiner*—Edward G. Favors
*Attorney, Agent, or Firm*—Hill, Gross, Simpson, Van Santen, Steadman, Chiara & Simpson

[57] ABSTRACT

In a liquid fuel burner wherein a fuel gasifying member is directly supported by a rotary shaft inserted in a main body of the burner for converting liquid fuel into gasified form, a water evaporation chamber of the annular shape is arranged at the corner of a top portion of the fuel gasifying member and filled therein with a water evaporation promoting material. Water is supplied to the water evaporation chamber and quickly converted into water vapor which is ejected into the fuel gasifying member through steam ejection apertures formed in the water evaporation chamber as the fuel gasifying member is rotated and performs the liquid fuel gasifying function, and the gasified fuel and water vapor form a mixture with air supplied under pressure, the mixture being ejected into the main body of the burner to sustain combustion of liquid fuel in gasified form, so that the consumption of thermal energy can be reduced by using water as part of the liquid fuel. Steam ejection apertures may also be formed in an outer wall of the water evaporation chamber to cause excess water vapor to be ejected therethrough into the main body of the burner where it burns with the flames of combustion of gasified fuel. The fuel gasifying member may include formed integrally therewith a skirt disposed at its bottom portion which is formed therein with gas ejection slits and which includes a lower portion received in a gas accumulation chamber formed in the main body of the burner to define a gasified fuel-air mixture passageway between the skirt and the gas accumulation chamber, the main body having a cold air passageway formed in its outer peripheral portion. Thus, a mixture of gasified fuel, water vapor and air can be ejected through the gasified fuel-air mixture passageway and the ejection slits to sustain combustion in a large area.

3 Claims, 11 Drawing Figures

LIQUID FUEL BURNER

This invention relates to a novel and useful liquid fuel burner which burns liquid fuel in gasified form by converting the liquid fuel and water into a mixture of gasified fuel and water vapor.

I have previously invented a liquid fuel burner for burning liquid fuel in gasified form wherein water is also made to burn as part of the liquid fuel in order to economize on thermal energy. In the aforesaid liquid fuel burner, a fuel gasifying member arranged in the main body of the burner for forced rotation is employed as means for converting liquid fuel into gasified form and water into water vapor, and a mixture of gasified fuel and air is formed by agitating and mixing, by means of a stream of air supplied under pressure, gasified fuel and water vapor which are formed from liquid fuel and water respectively while they are caused to diffuse and move along the inner surface of the fuel gasifying member.

Thus, in the liquid fuel burner mentioned above, the evaporating surface on which water is converted into water vapor and the vaporizing surface on which liquid fuel is converted into gasified form are disposed in the same position. Since the liquid fuel and water are immiscible and separated from each other at all times, the temperature at which the water evaporates is lower than the temperature at which the liquid fuel is gasified when the volume of water supplied is increased above a certain level, so that gasifying of the liquid fuel in the fuel gasifying member is prevented and the volume of gasified fuel produced is reduced because of the thermal exchange effected by evaporation of the increased volume of water. Moreover, a portion of the water supplied to the evaporating surface which coincides with the vaporizing surface for the liquid fuel forms a minuscule droplets of water, thereby interfering with the formation of a gas-air mixture.

It has been discovered that difficulty is experienced, when the liquid fuel burner mentioned above is employed, in obtaining uniform combustion of the liquid fuel in gasified form, and that no satisfactory results can be obtained in the functioning of the burner.

The present invention obviates the aforementioned disadvantages of the prior art by arranging an independent water evaporation chamber of an annular shape at the corner of the top portion of said fuel gasifying member, and disposed along the inner periphery thereof, where the highest temperature is expected, in consideration of the difference of evaporating temperatures of water and liquid fuel, in order to obtain constant and appropriate mixture of gasified fuel and water vapor, otherwise non-vaporized water sometimes mixes with gasified fuel and thus stable combustion is not obtainable. Accordingly, a main object of the invention is to provide a liquid fuel burner which burns liquid fuel in gasified form by converting the liquid fuel and water into a mixture of gasified fuel and water vapor, wherein an evaporation chamber in which water can be converted into water vapor in no time is provided at one portion of the inner surface of the fuel gasifying member forcedly rotated within the main body of the burner, the water vapor vigorously ejected from the evaporation chamber into the interior of the fuel gasifying member being mixed immediately with the gasified fuel produced while the liquid fuel is caused to diffuse and move along the inner wall surface of the fuel gasifying member to immediately produce a mixture of gasified fuel, water vapor and air which is ejected from the fuel gasifying member, so that the liquid fuel can be burned in gasified form.

Another object of the invention is to provide a liquid fuel burner which burns liquid fuel in gasified form by converting the liquid fuel and water into a mixture of gasified fuel and water vapor, wherein an evaporation chamber positively capable of converting the supplied water into water vapor and ejecting the same into the interior of the fuel gasifying member is provided in the fuel gasifying member for quickly converting the liquid fuel into gasified form, and wherein the gasified fuel and water vapor can be positively produced to form a mixture of proper portions of gasified fuel, air and water vapor, whereby the burner can satisfactorily perform the function of burning the liquid fuel in gasified form and yet the consumption of the liquid fuel can be reduced.

Still another object of the invention is to provide a liquid fuel burner which burns liquid fuel in gasified form by converting the liquid fuel and water into a mixture of gasified fuel and water vapor, wherein an evaporation chamber for producing the water vapor is disposed at the corner of a top portion of the fuel gasifying member where the heating function of the flames of combustion is performed most powerfully, and wherein production of the water vapor can take place quickly and positively and at the same time the damage which would otherwise be caused to the fuel gasifying member by combustion can be avoided, so that the water can be gasified and burned as part of the fuel.

Still another object of the invention is to provide a liquid fuel burner which burns liquid fuel in gasified form by converting the liquid fuel and water into a mixture of gasified fuel and water vapor, wherein an evaporation chamber provided at the corner of a top portion of the fuel gasifying member is filled with an evaporation promoting material and formed in its periphery with a multitude of water vapor ejection apertures to enable supplied water to be converted into water vapor in a short interval of time and to enable the water vapor produced to be ejected uniformly into the fuel gasifying member, whereby the water vapor can mix well with gasified liquid fuel.

Still another object of the invention is to provide a liquid fuel burner which burns liquid fuel in gasified form by converting the liquid fuel and water into a mixture of gasified fuel and water vapor, wherein an evaporation chamber provided at the corner of a top portion of the fuel gasifying member is formed with water vapor ejection openings in the outer wall of the evaporation chamber too, so that excess water vapor produced in the evaporation chamber will be ejected outwardly from the fuel gasifying member and mixed with the flames of combustion taking place within the main body of the burner to thereby promote combustion of liquid fuel in gasified form.

A further object of the invention is to provide a liquid fuel burner which burns liquid fuel in gasified form by converting the liquid fuel and water into a mixture of gasified fuel and water vapor, wherein a skirt is provided at an open end of the fuel gasifying member which is provided with an evaporation chamber as aforementioned, the skirt being formed therein with a multitude of ejection slits and the skirt having a lower half portion which is inserted in a gas accumulating chamber formed substantially on the inner wall side of the main body of the burner, with a gas ejection passageway being formed between the skirt and the gas accumulating chamber through which a mixture of gasified fuel, air and water vapor can be ejected into the main body of the burner, thereby avoiding damage by combustion which would otherwise be caused to the fuel gasifying member due to concentration of the flames of combustion of gasified fuel on the fuel gasifying member.

Additional and other objects and features of the invention will become evident from the description of various embodiments set forth hereinafter when considered in conjunction with the accompanying drawings, in which.

Figure 1:
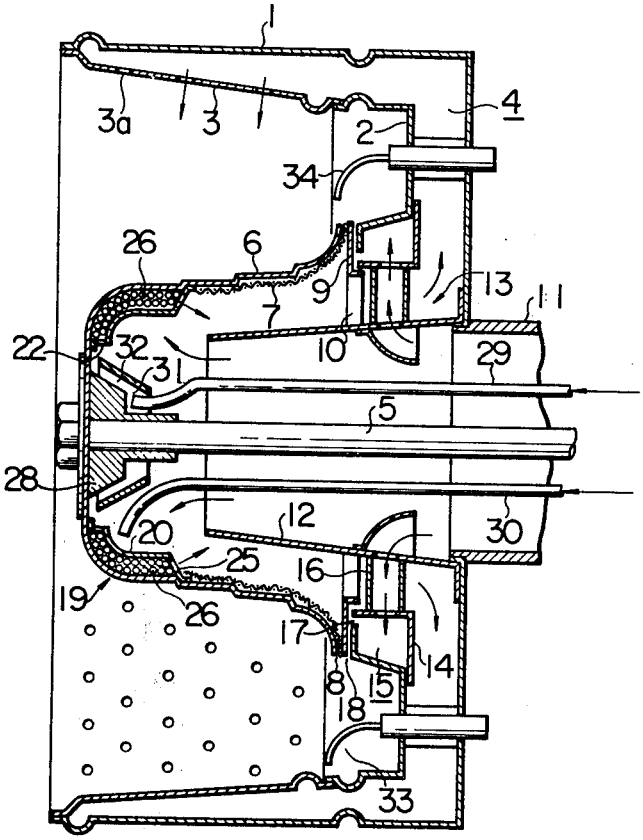
FIG. 1 is a vertical sectional view, with certain parts being cut out of a first embodiment of the liquid fuel burner which is of the basic form according to the invention and which is provided with an evaporation chamber disposed at the corner of a top portion of the fuel gasifying member for producing water vapor adapted to be ejected into the interior of the fuel gasifying member.
Figure 2:
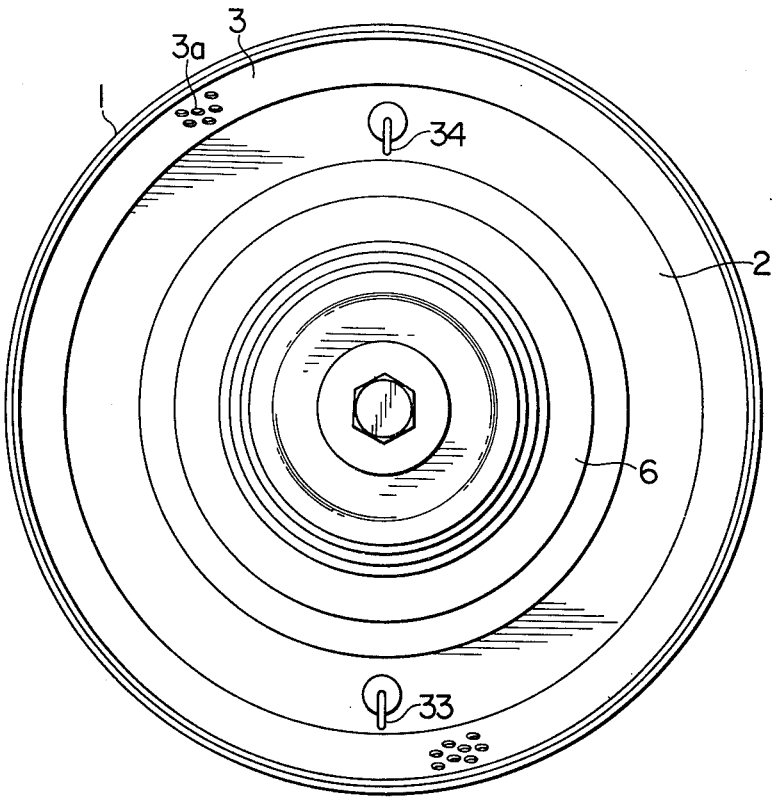
FIG. 2 is a side view, as seen from the left side of FIG. 1, of the burner shown in FIG. 1.

The first embodiment of the invention which represents the burner of the basic form shown in FIG. 1 to FIG. 4 will now be described in detail.

1 refers to a main body of the burner made as of thin metallic material, e.g. sheet metal, the main body 1 being open at one end and having detachably mounted at the other end an air supply duct 11. As shown in the first embodiment illustrated in FIG. 1, the main body 1 has an inner wall plate 2 and a combustion plate 3 contiguous with each other and mounted along inner periphery thereof, the combustion plate 3 being formed therein with a multitude of gas ejection ports 3*a*. A gas chamber 4 is defined between the main body 1 on the one hand and the inner wall plate 2 and the combustion plate 3 on the other hand.

A rotary shaft 5 extending substantially through the central portion of the main body 1 has directly supported thereby a fuel gasifying member 6 which is open at one end and adapted to cause the supplied liquid fuel to quickly vaporize and gasify while the liquid fuel is caused to diffuse and travel along the inner wall surface thereof. A gas-air mixing plate 9, through which a gas passageway 10 extends, is mounted at the open end portion of the fuel gasifying member 6 in such a manner that a gap 8 is formed between the fuel gasifying member 6 and the gas-air mixing plate 9 through a flow-down preventing member 7 made of wire netting and attached to the inner wall surface of the fuel gasifying member 6. An air blast supply duct 12 connected at one end to the air supply duct 11 extends through and opens at the other end in the fuel gasifying member 6 to deliver an air blast under pressure.

Formed substantially in the central portion of the gas chamber 4 is a communicating opening 13 through which communication can be maintained between the fuel gasifying member 6 and the gas chamber 4. An annular air ejection chamber 15 formed therein with an air ejection opening 17 is defined by the inner wall plate 2 and a wall plate 14 and disposed at one side of the gas-air mixing plate 9 or in a position where the communicating opening 13 is formed. The air ejection chamber 15 is connected through a communicating pipe 16 to the air blast supply duct 12, so as to cause a portion of the air blast supplied under pressure through the air blast supply duct 12 to be ejected toward the inner wall plate 2 through an air ejection gap 18 formed between the gas-air mixing plate 9 and the air ejection chamber 15 to thereby form an air curtain on the inner wall plate 2. This arrangement has the effect of avoiding damage which would otherwise be caused to the inner wall plate 2 by the flames of combustion.

Figure 3:
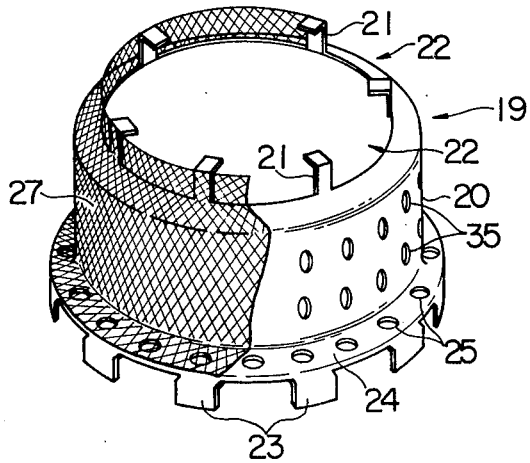
FIG. 3 is a perspective view, with certain parts being cut away, of the evaporation chamber which is one of the features of the invention.
Figure 4:
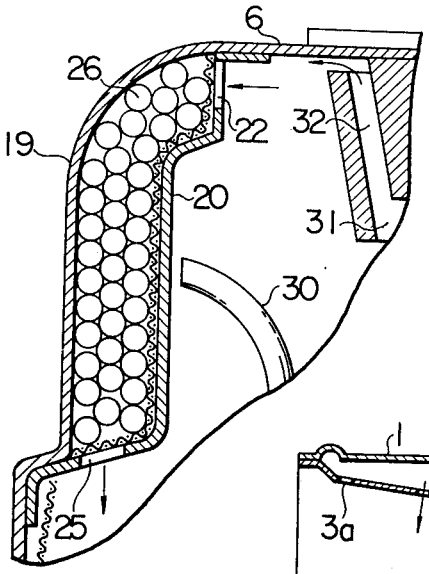
FIG. 4 is vertical sectional view, on an enlarged scale, of the evaporation chamber, with certain parts being cut out.

19 refers to an water evaporation chamber which is annular in shape and disposed on the inner wall surface of the corner of a substantially top portion of the fuel gasifying member 6 in such a manner that the evaporation chamber 19 protrudes inwardly. The evaporation chamber 19 is formed by mounting on the inner wall surface of the fuel gasifying member 6 an annular cylindrical member 20 to define therebetween a vacant space. As shown in FIG. 3, the annular cylindrical member 20 is formed by shaving at one end with a plurality of attaching portions 21 to form therebetween a number of water inlet ports 22, and bent outwardly at the other end at which is formed integrally therewith a number of attaching portions 23. The annular cylindrical member 20 is also formed with a bent surface portion 24 in which a number of steam ejection apertures 25 are formed. The evaporation chamber 19 constructed as aforementioned is filled with a heat resisting water evaporation promoting material 26 which may be made of ceramics, manganese dioxide or a compound thereof with the annular cylindrical member 20 being covered with a wire net 27.

28 designates a water supply member attached to substantially the central inner surface of the top of the fuel gasifying member 6 and adapted to perform the function of evenly feeding water to the inner wall surface of the fuel gasifying member. The water supply member 28 is constructed such that it comprises an annular water feed chamber 31 receiving at one side thereof a water feed line 29 which opens therein, and a plurality of water feed passageways 32 divergingly tapering from the liquid feed chamber 31 and opening on the inner wall surface of the fuel gasifying member 6. The rotary shaft 5 extends through the liquid supply member 28 which is disposed on the inner side of the fuel gasifying member 6. A liquid fuel supply line 30 opens near the inner surface of the annular cylindrical member 20. 33 is an ignition plug used for burning the fuel in atomized particles while 34 is an ignition plug used for burning the fuel in gasified form.

In the basic form of fuel burner for burning liquid fuel in gasified form constructed as aforementioned according to the invention, rotation of the rotary shaft 5 results in simultaneous rotation of the fuel gasifying member 6 and the liquid supply member 28. Then, liquid fuel is supplied through the liquid fuel supply line 30 to the surface of the annular cylindrical member 20, and at the same time an air blast is supplied under pressure through the air supply duct 11 and the air blast supply duct 12. This causes the supplied liquid fuel to diffuse into a thin film form while it moves from the annular cylindrical member 20 to the inner wall surface of the fuel gasifying member 6, by virtue of the flow-down preventing action of the flow-down preventing member 7, the diffusing action of the centrifugal forces and the ejection scattering action of the air blast. Thus, the liquid fuel is scattered in atomized particles to the surroundings through the gap 8 at the open end of the fuel gasifying member 6, and ignited to start combustion of the fuel in atomized particles.

While the fuel burns in atomized particles in this way, a portion of the air blast supplied under pressure is delivered through the air ejection chamber 15 and ejected outwardly through the air ejection opening 17 and the air ejection gap 18, so as to thereby form an air curtain on the inner wall plate 2. The provision of the air curtain permits the combustion to be sustained without the flames heating the inner wall surface 2, with the result that the fuel gasifying member 6 and the evaporation chamber 19 are quickly heated.

With the fuel gasifying member 6 being heated in this way, the liquid fuel supplied through the fuel supply line 30 is vaporized and gasified while being caused to diffuse as aforesaid. The gasified fuel produced is quickly mixed at the gas-air mixing plate 9 with the air blast and converted into a fuel-air mixture which is delivered under pressure to the gas chamber 4. The fuel-air mixture in the gas chamber 4 is vigorously ejected therefrom through the gas ejection ports **3*a* and ignited to start combustion of the fuel in gasified form. Thus, the fuel burns in blue flames within the main body 1 of the burner. With the fuel burning in blue flames, water is supplied through the water feed line 29 to the liquid supply member 28 without interrupting the supply of liquid fuel through the fuel supply line 30. The water fed to the liquid supply member 28 is scattered evenly through the liquid feed passageways 32 onto the inner wall surface of the fuel gasifying member 6, and moves therealong till it enters the evaporation chamber 19 through the water inlet parts 22 where it is quickly converted into water vapor by the heating action of the evaporation promoting material 26 which has already been brought to elevated temperatures by the heating action of the flames of combustion of fuel in gasified form. The water vapor thus produced is ejected through the steam ejection apertures 25 into the interior of the fuel gasifying member 6 where it forms a perfect fuel-air-water vapor mixture with the gasified fuel which has been produced by vaporization and gasification of the liquid fuel and the air blast supplied under pressure. The fuel-air-water vapor mixture is ejected from the gas chamber 4 under a predetermined pressure through the gas ejection ports 3*a*** to sustain combustion of the fuel in gasified form.

In the liquid fuel burner for burning liquid fuel in gasified form according to the invention, the aforementioned features enable water to be used as part of the fuel like the liquid fuel. This is conductive to reduced consumption of fuel. In addition, the water supplied from outside is caused to evaporate into water vapor in the evaporation chamber 19 disposed in the portion of the fuel gasifying member 6 which is heated most intensely, and the water vapor is mixed with gasified fuel in a perfect gaseous condition. Thus, what results is a perfect fuel-air mixture whose volume is increased by the addition of water vapor, so that the flames of combustion can be increased and combustion of fuel in gaseous state can be sustained at a higher level. Moreover, since water is evaporated in the evaporation chamber 19. Production of water vapor takes place positively, uniformly and quickly, so that the burner according to the invention is particularly useful in maintaining the combustion of water-added fuel in gasified form for a prolonged time interval.

In the first embodiment of the burner representing the basic form of the burner for burning liquid fuel in gasified form, the provision of a multitude of steam ejection ports 35 in the wall of the annular cylindrical member 20 for forming the evaporation chamber 19 as shown in FIG. 3 will enable a large volume of water vapor to be evenly ejected into the interior of the fuel gasifying member 6, thereby permitting to increase the total energy of the combustion of the burner for burning liquid fuel in gasified form to the proportion of burning of water vapor.

Figure 5:
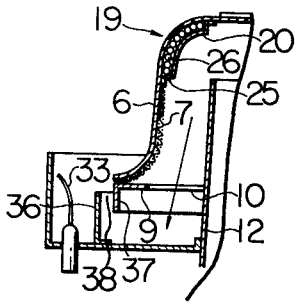
FIG. 5 is a vertical sectional front view, with certain parts being cut out, of a second embodiment of the invention in which the fuel gasifying member of the first embodiment shown in FIG. 1 to FIG. 4 is used to enable the liquid fuel to burn in gasified form.

FIG. 5 shows a second embodiment of the burner for burning liquid fuel in gasified form which is provided with the evaporation chamber 19 according to the invention. The second embodiment is distinguished from the first embodiment in that in the former the gas chamber 4 is not disposed along the entire inner periphery of the main body 1 of the burner as in the latter, and an upstanding cylindrical wall 36 is provided inside the main body 1 and receives therein the open end portion of the fuel gasifying member 6, so that a gas ejection passageway 38 in annular form will be formed between the upstanding cylindrical wall 36 and an upstanding wall portion 37 of the gas-air mixing plate 9.

Figure 6:
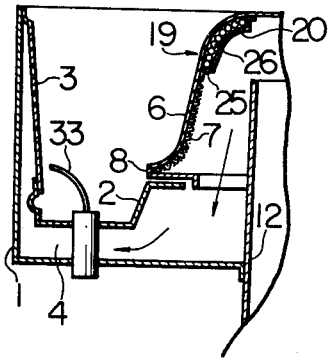
FIG. 6 is a vertical sectional front view, with certain parts being cut out, of a third embodiment of the invention in which the fuel gasifying member of the first embodiment shown in FIG. 1 to FIG. 4 is used to enable the liquid fuel to burn in gasified form.

FIG. 6 shows a third embodiment of the burner for burning liquid fuel in gasified form according to the invention. This embodiment is distinguished from the first embodiment in that the air ejection chamber 15 provided in the latter is not formed in the former, and that a mixture of air and fuel produced is ejected from the gas chamber 4 through the combustion plate 3 to sustain combustion of liquid fuel in gasified form.

Figure 7:
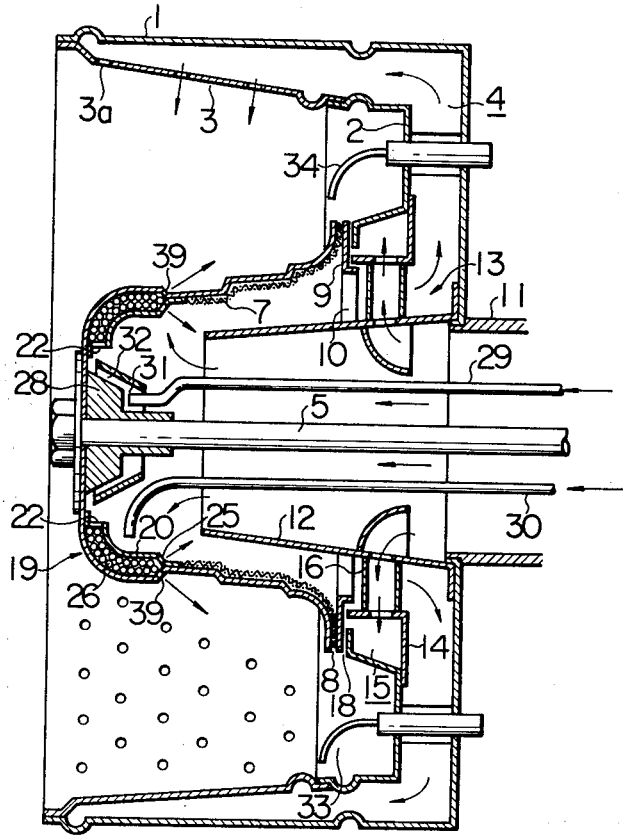
FIG. 7 is a vertical sectional front view, with certain parts being cut out, of another embodiment of the invention in which part of the water vapor produced in the evaporation chamber is ejected out of the fuel gasifying member and mixed with the flames of combustion of gasified fuel, so that combustion of the gasified fuel can be sustained satisfactorily.
Figure 8:
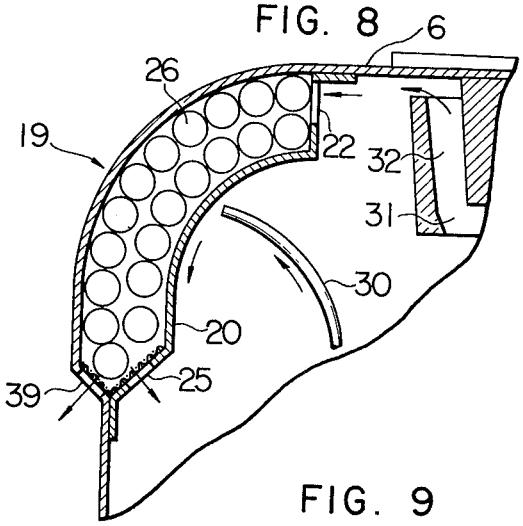
FIG. 8 is a vertical sectional view, on an enlarged scale, of the essential portions of the embodiment shown in FIG. 7, with certain parts being cut out.

A fourth embodiment of the invention shown in FIG. 7 and FIG. 8 represents an improvement of the basic form of burner for burning liquid fuel in gasified form shown in FIG. 1 to FIG. 4. The improvement comprises the provision of a suitable number of steam ejection apertures 39 in an outer wall of the evaporation chamber 19 provided at the corner of a top portion of the fuel gasifying member 6 or in the outer wall of the fuel gasifying member 6 for causing excess water vapor to be ejected therethrough into the main body 1 of the burner when a large volume of water is supplied to the evaporation chamber 19. The excess water vapor thus ejected into the main body 1 will mix with the flames of combustion of liquid fuel in gasified form, thereby promoting and sustaining combustion. This feature offers the advantage of permitting excess water vapor to be ejected and burned in the main body 1 of the burner even if the operator erroneously supplies the evaporation chamber 19 with water in an amount which is higher than the predetermined level for producing a mixture of gasified fuel and water vapor of correct or proper proportions, with the result that a constant volume of water vapor is ejected into the interior of the fuel gasifying member 6 at all times and the mixture of gasified fuel and water vapor can be maintained at predetermined proportions. Thus, water can be used effectively as part of the liquid fuel for gasification and combustion.

Figure 9:
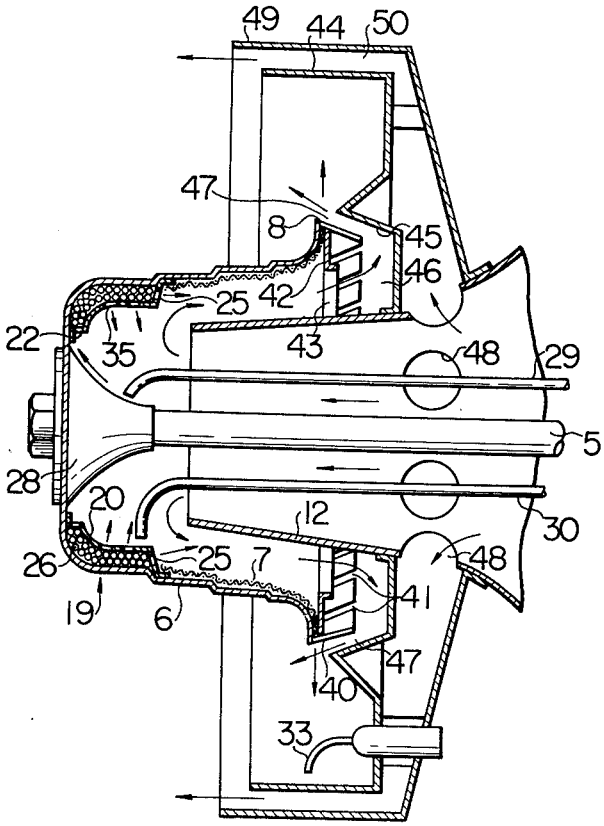
FIG. 9 is a vertical sectional front view, with certain parts being cut out, of another embodiment of the invention which is provided with a modified form of the fuel gasifying member provided with the evaporation chamber.
Figure 10:
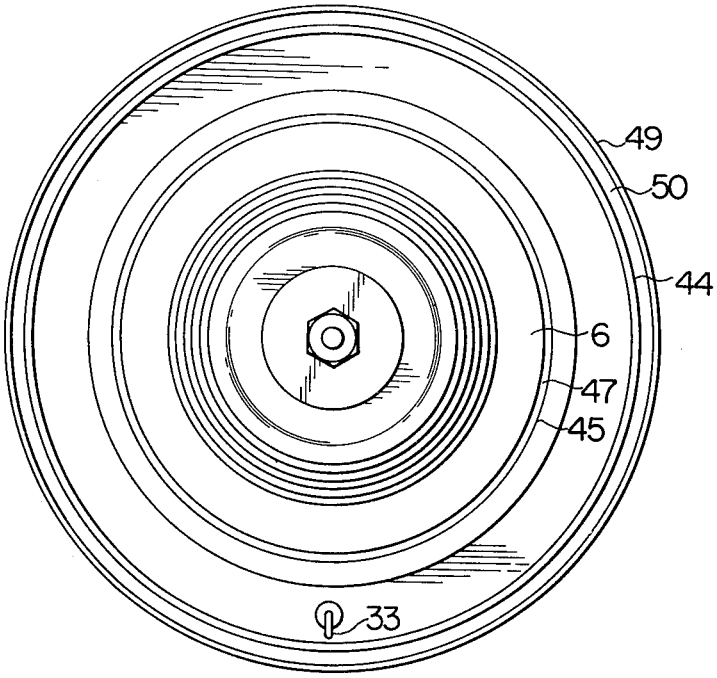
FIG. 10 is a side view, as seen from the left side of the burner shown in FIG. 9.
Figure 11:
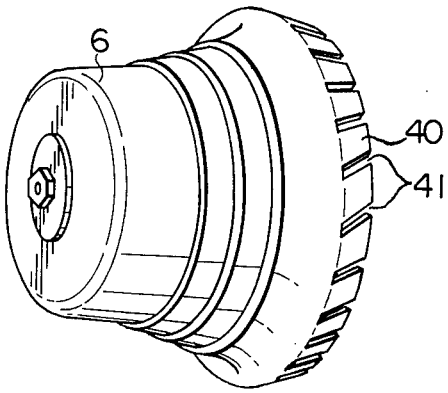
FIG. 11 is a perspective view of the fuel gasifying member as a whole of the embodiment shown in FIG. 9 and FIG. 10.

FIG. 9 to FIG. 11 show a fifth embodiment of the invention which includes an improved form of fuel gasifying member 6 provided with the evaporation chamber 19 as shown in the basic form of burner according to the invention. The use of the improved form of fuel gasifying member enables a mixture of gasified fuel and air to be ejected and burned by eliminating the combustion plate 3 formed therein with a multitude of gas ejection ports *3a* provided in the basic form of the burner.

The features of the fifth embodiment are that the fuel gasifying member, even if made of a thin metallic material, e.g. sheet metal, can be used for a prolonged priod of time to sustain combustion of fuel in gasified form without being damaged by the flames of combustion of liquid fuel in gasified form, and that damage to the main body 1 of the burner which would otherwise be caused thereto by the flames of combustion if the main body 1 is made of a thin metallic material, e.g. sheet metal, can be avoided. To this end, the fuel gasifying member 6 of the fifth embodiment of the invention, which is provided with the evaporation chamber 19 at the corner of the top portion thereof as is the case with the basic form of burner, is formed integrally with a skirt 40 at the open end of the fuel gasifying member 6 which skirt 40 slightly tilts inwardly as best shown in FIG. 11. The skirt 40 is formed therein with a multitude of ejection slits 41, and a gasified fuel-air mixing plate 42 is fitted to the inner wall surface of the base portion of the skirt 40 to define a gasified fuel-air mixture passageway 43 between the plate 42 and the outer wall surface of the air blast supply duct 12.

The fuel gasifying member 6 of the aforesaid construction is directly supported by the rotary shaft 5 and arranged such that the lower half portion of the skirt 40 is inserted in a gas accumulation chamber 46 formed by causing an inner wall 45 of a main body 44 of the burner to protrude inwardly. Thus, an obliquely outwardly directed annular gas ejection passageway 47 is defined between the skirt 40 and the gas accumulation chamber 46. Arranged outside the main body 44 of the burner is a cold air stream supply cylindrical member 49 which cooperates with the main body 44 to define therebetween a cold air stream passageway 50 which is maintained at its base portion in communication, through communication ports 48, with the air blast supply duct 12 which is inserted in the fuel gasifying member 6 to open therein.

In the fifth embodiment of the invention of the aforesaid construction, the liquid fuel supplied to the interior of the fuel gasifying member 6 is caused to diffuse and move along the inner wall surface of the fuel gasifying member 6 which is rotated by the rotary shaft 5. Then, the liquid fuel is scattered in atomized particles through the base side of the multitude of ejection slits 41 formed in the periphery of the skirt 40 and directed against the inner surface of the main body 44 of the burner, so that the liquid fuel in atomized particles is ignited by the ignition plug 33 and burns. The flames of combustion of the liquid fuel in atomized particles heats the fuel gasifying member 6, so that the liquid fuel supplied to the interior of the fuel gasifying member 6 can be made to vaporize and gasify while diffusing and travelling along its inner wall surface. The liquid fuel thus gasified is agitated and mixed with an air blast supplied under pressure, and a mixture of gasified fuel and air is ejected through the ejection slits 41 and moves through the gas ejection passageway 47 to burn in gasified form. After initiation of combustion of the liquid fuel in gasified form, the water vapor produced by feeding water to the evaporation chamber 19 is mixed with the mixture of gasified fuel and air. The mixture of gasified fuel, air and water vapor is temporarily accumulated in the gas accumulation chamber 46 before being ejected through the ejection slits 41 and gas ejection passageway 47 as aforementioned to sustain combustion of the liquid fuel in gasified form in a large area.

By causing the mixture of gasified fuel and air to be ejected toward the main body 44 of the burner to maintain combustion in a large area, it is possible to divert the flames of combustion of liquid fuel in gasified form from the fuel gasifying member 6 without being concentrated thereon. This enables to avoid damage which would otherwise be caused to the fuel gasifying member 6 by combustion and to promote the production of the mixture of gasified fuel and air. At the same time, part of the air blast supplied through the air blast supply duct 12 is caused to move along the cold air stream passageway 50 to thereby avoid damage which would otherwise be caused to the main body 44 of the burner by combustion. The air blast supplied through the cold air stream passageway 50 also performs the function of increasing the length of the flames of combustion of liquid fuel in gasified form in a forward direction, thereby enabling to use the flames of combustion of liquid fuel in gasified form as a heating source.

From the foregoing description, it will be appreciated that the burner for burning liquid fuel in gasified form according to the present invention offers many advantages. Preliminary combustion of the liquid fuel in atomized particles simultaneously heats the fuel gasifying member 6 which is rotated by the rotary shaft 5 and the evaporation chamber 19 which is provided at the corner of the top portion of the member 6. The liquid fuel supplied to the interior of the fuel gasifying member 6 and the water supplied to the evaporation chamber 19 are positively vaporized, and the gasified fuel and water vapor produced in this way are agitated and mixed in the fuel gasifying member 6 under the influences of an air blast supplied to the fuel gasifying member 6 under pressure, so that a perfect mixture of gasified fuel, water vapor and air can be produced to sustain combustion of the liquid fuel in gasified form.

According to the invention, the volume of water vapor or gasified fuel which can be produced independently of each other can be increased as desired, so that the capacity of the burner to maintain combustion of liquid fuel in gasified form can be increased. Thus, the invention provides a most efficient burner for burning liquid fuel in gasified form as the evaporation chamber 19 where water vapor can be produced is provided at the corner of the top portion of the fuel gasifying member 6 which is most liable to be damaged by over heat, the part of the fuel gasifying member 6 can be prevented from over heat, so that a mixture of gasified fuel and air of correct or proper proportions can be produced by utilizing water as part of the liquid fuel. This is conducived to reduced consumption of thermal energy.

What is claimed is:

1. A liquid fuel burner for burning liquid fuel in gasified form by converting the liquid fuel and water into a mixture of gasified fuel and water vapor comprising:

a main body of the burner;

a rotary shaft inserted in said main body of the burner;

a fuel gasifying member directly supported by said rotary shaft for converting the liquid fuel supplied thereto into gasified form while the liquid fuel is caused to diffuse and move in thin film form on an inner wall surface thereof;

water supply means attached to the central portion of the inner surface of the top of said fuel gasifying member;

an air blast supply duct inserted in said fuel gasifying member for supplying an air blast under pressure into the interior of said fuel gasifying member;

a water evaporation chamber of the annular shape arranged at the corner of a top portion of said fuel gasifying member and disposed along inner periphery thereof, said water evaporation chamber being filled with a water evaporation promoting material for quickly converting the water supplied thereto into water vapor; and a multitude of steam ejection apertures formed in said water evaporation chamber for ejecting the water vapor produced in said water evaporation chamber into the interior of said fuel gasifying member where the water vapor is mixed with the gasified fuel produced by vaporization and gasification of the liquid fuel, said mixture of gasified fuel and water vapor being further mixed with air supplied under pressure through said air blast supply duct, whereby a mixture of gasified fuel, water vapor and air can be ejected into the main body of the burner to sustain combustion of the liquid fuel in gasified form.

2. A liquid fuel burner for burning liquid fuel in gasified form by converting the liquid fuel and water into a mixture of gasified fuel and water vapor comprising:

a main body of the burner;

a rotary shaft inserted in said main body of the burner;

a fuel gasifying member directly supported by said rotary shaft for converting the liquid fuel supplied thereto into gasified form while the liquid fuel is caused to diffuse and move in thin film form on an inner wall surface thereof;

water supply means attached to the central portion of the inner surface of the top of said fuel gasifying member;

a water evaporation chamber of the annular shape arranged at the corner of a top portion of said fuel gasifying member and disposed along inner periphery thereof, said water evaporation chamber being filled with a water evaporation promoting material for quickly converting the water supplied thereto into water vapor;

a multitude of steam ejection aperture formed in an inner wall of said water evaporation chamber for ejecting part of the water vapor produced in said evaporation chamber into the interior of said fuel gasifying member where the water vapor is mixed with the gasified fuel produced by vaporization and gasification of the liquid fuel, said mixture of gasification of the liquid fuel, said mixture of gasified fuel and water vapor being further mixed with air supplied under pressure so that the mixture of gasified fuel, water vapor and air can be ejected and burned in said main body of the burner; and a number of steam ejection apertures formed in an outer wall of said evaporation chamber for ejecting part of the water vapor produced in said water evaporation chamber into the main body of the burner where the water vapor is burned in the flames of combustion of the liquid fuel in gasified form.

3. A liquid fuel burner for burning liquid fuel in gasified form by converting the liquid fuel and water into a mixture of gasified fuel and water vapor comprising:

a main body of the burner formed in its outer marginal portion with a cold air stream passageway for permitting a stream of cold air to flow therethrough;

a rotary shaft inserted in said main body of the burner;

a fuel gasifying member directly supported by said rotary shaft;

water supply means attached to the central portion of the inner surface of the top of said fuel gasifying member;

a skirt formed integrally with said fuel gasifying member and disposed at an open end portion thereof, said skirt being formed therein with a multitude of ejection slits;

a water evaporation chamber of the annular shape arranged at the other end of said fuel gasifying member or at the corner of a top portion thereof and filled with a water evaporation promoting material, said water evaporation chamber being formed in its inner wall surface with a multitude of steam ejection apertures; and a gas accumulating chamber provided in the main body of the burner for receiving therein a lower half portion of said skirt of said fuel gasifying member to define a gasified fuel-air mixture passageway between the skirt and the gas accumulation chamber, the gasified fuel produced in said fuel gasifying member and the water vapor produced in said water evaporation chamber being mixed with air supplied under pressure into the interior of said fuel gasifying member, so that a mixture of gasified fuel, water vapor and air can be ejected through said gasified fuel-air mixture passageway and said ejection slits to sustain combustion in a large area.

* * * * *